US007566824B2

(12) United States Patent
Small

(10) Patent No.: US 7,566,824 B2
(45) Date of Patent: Jul. 28, 2009

(54) CAPO

(75) Inventor: Craig Small, Framingham, MA (US)

(73) Assignee: First Act Inc., Boston, MA (US)

( * ) Notice: Subject to any disclaimer, the term of this patent is extended or adjusted under 35 U.S.C. 154(b) by 0 days.

(21) Appl. No.: 11/852,943

(22) Filed: Sep. 10, 2007

(65) Prior Publication Data

US 2009/0064842 A1 Mar. 12, 2009

(51) Int. Cl.
*G10D 3/00* (2006.01)

(52) U.S. Cl. ..... 84/318

(58) Field of Classification Search ..... 84/318
See application file for complete search history.

(56) References Cited

U.S. PATENT DOCUMENTS

| | | | | | |
|---|---|---|---|---|---|
| 608,278 | A * | 8/1898 | Benson | 84/318 |
| 749,616 | A * | 1/1904 | Knell | 84/329 |
| 3,752,029 | A * | 8/1973 | Watrous | 84/329 |
| 4,143,576 | A * | 3/1979 | Nichols et al. | 84/318 |
| 4,467,693 | A * | 8/1984 | Nasfell, Jr. | 84/329 |
| 4,583,440 | A * | 4/1986 | Powell, Jr. | 84/318 |
| 4,785,708 | A * | 11/1988 | Vaughan | 84/329 |
| 4,890,531 | A * | 1/1990 | Tischer | 84/329 |
| D309,674 | S * | 8/1990 | Gervase | D3/226 |
| 5,127,300 | A * | 7/1992 | Silverman | 84/329 |
| 5,299,485 | A * | 4/1994 | Denton | 84/329 |
| D355,667 | S * | 2/1995 | Burger | D17/20 |
| D378,825 | S * | 4/1997 | Dunlop | D17/20 |
| 5,651,468 | A * | 7/1997 | Irizarry | 211/120 |
| 5,796,021 | A * | 8/1998 | Longshore | 84/329 |
| 6,008,441 | A * | 12/1999 | Steinberger | 84/318 |
| 6,096,954 | A * | 8/2000 | Hatfield | 84/329 |
| 6,215,052 | B1 * | 4/2001 | Giddens et al. | 84/329 |
| 6,459,025 | B1 * | 10/2002 | D'Addario | 84/318 |
| 6,528,711 | B1 * | 3/2003 | Paige | 84/318 |
| 6,573,440 | B1 * | 6/2003 | Rodriguez | 84/318 |
| 6,635,813 | B2 * | 10/2003 | Campling | 84/318 |
| 6,639,136 | B1 * | 10/2003 | Judd | 84/329 |
| 6,965,067 | B2 * | 11/2005 | Kondo | 84/455 |
| 7,012,181 | B2 * | 3/2006 | Tran | 84/318 |
| D533,211 | S * | 12/2006 | Kyser | D17/20 |
| D573,629 | S * | 7/2008 | Steinberger | D17/20 |
| D574,416 | S * | 8/2008 | Small et al. | D17/20 |
| 2005/0087056 | A1 * | 4/2005 | Zager et al. | 84/318 |
| 2008/0168882 | A1 * | 7/2008 | Campling | 84/318 |
| 2009/0064842 | A1 * | 3/2009 | Small | 84/318 |

* cited by examiner

*Primary Examiner*—Lincoln Donovan
*Assistant Examiner*—Robert W Horn
(74) *Attorney, Agent, or Firm*—Townsend and Townsend and Crew LLP

(57) ABSTRACT

A capo for use with a stringed musical instrument includes a frame that includes a first arm configured to extend across a neck of the instrument, and a second arm connected to the first arm and extending from the first arm at a first angle less than 180°, the capo further including a pivot arm that is substantially Y-shaped, includes base, actuator, and clamp portions and is pivotally connected to the frame to move between open and closed positions, a proximal end of the clamp portion is connected to the distal end of the base portion, the clamp portion extending away from the base portion toward the first arm when the pivot arm is in the closed position, the base portion being biased away from the second arm such that the clamp portion is biased toward the first arm.

12 Claims, 5 Drawing Sheets

CAPO

BACKGROUND OF THE INVENTION

A capo is a mechanical device that removably attaches to the neck of a stringed musical instrument, such as a guitar, to selectively change the key or pitch of the sound elicited from the instrument when the strings are played. A guitar capo, for instance, can be disposed along the neck of a guitar behind one of the frets of the guitar neck. The capo covers and presses against the strings of the instrument to change the key or pitch of the open operative strings located below the capo. Each fret of a guitar is a half step or a semi-tone higher or lower relative to other frets along the fret board. When a capo is placed behind a certain fret, the open operative strings below the fret, when played, emit chord sounds that are higher in key or pitch by the number of semi-tones of the fret. For instance, if the capo is placed behind the first fret, all the open strings will be raised one semi-tone. In this case, when a person plays a G chord, the chord sound is G#/Ab. When the capo is placed behind the second fret, the open strings are raised by a whole tone, such that, when a G chord is played, an A chord sound is produced. Similarly, when the capo is placed behind the third fret, the open strings are raised by three semi-tones and a G chord would sound like an A#/Bb chord. By using a capo, a person can play familiar chords relative to the capo, but would produce different chord sounds, and/or chord sounds that are more difficult to play without using a capo. In general, if the capo is placed behind an X fret, the chord sounds will be X semi-tones higher in key or pitch than the chord sounds elicited without the use of the capo.

BRIEF SUMMARY OF THE INVENTION

In general, in an aspect, the invention provides a capo for use with a stringed musical instrument, the capo including a frame that includes a first arm having distal and proximal ends and being configured to extend across a neck of the instrument and engage strings of the instrument, and a second arm connected to the proximal end of the first arm and extending from the first arm at a first angle less than 180°, the second arm configured and disposed to receive a portion of a person's hand, the capo further including a pivot arm that is substantially Y-shaped, including a base portion, a clamp portion, and an actuator portion, a proximal end of the base portion being pivotally connected to the frame to move between open and closed positions, the base portion extending away from the frame inside the first angle, a proximal end of the actuator portion connected to a distal end of the base portion, the actuator portion extending away from the base portion, the first arm, and the second arm when the pivot arm is in the closed position, a proximal end of the clamp portion connected to the distal end of the base portion, the clamp portion extending away from the base portion toward the first arm when the pivot arm is in the closed position, the base portion being biased away from the second arm such that the clamp portion is biased toward the first arm.

Implementations of the invention may include one or more of the following features. The base portion extends away from the frame at a second angle relative to the first arm when the pivot arm is in the closed position and the actuator portion extends away from the first arm at substantially the second angle relative to the first arm when the pivot arm is in the closed position. The capo further includes a pick holder connected to the top arm and configured to removably hold at least one guitar pick. The pick holder provides slots having widths smaller than thicknesses of guitar picks and having depths extending at acute angles relative to a length of the top arm. The second arm has a concave outer surface for receiving a portion of a person's hand. The base portion has a length of about three-fourths of a length of the actuator portion. The actuator portion includes a finger-receiving portion configured to receive fingers of a user of the capo, where a first distance from a pivot point of the pivot arm to a midpoint of the finger-receiving portion of the actuator portion is about 2.25 inches, and a second distance from the midpoint of the finger-receiving portion to a midpoint of a contoured portion of the second arm is about 1.75 inches.

In general, in another aspect, the invention provides a capo for use with a guitar, the capo including a frame that includes a first arm having distal and proximal ends and being configured to extend across a neck of the instrument and engage strings of the instrument, the first arm providing slits having widths smaller than thicknesses of guitar picks, and a second arm connected to the proximal end of the first arm and extending from the first arm at a first angle less than 180°, the second arm configured and disposed to receive a portion of a person's hand, the capo further including a pivot arm pivotally connected to the frame and including a clamp portion and an actuator portion, the clamp portion being configured to engage a bottom of a neck of the stringed instrument, the actuator portion being configured to be engaged by a portion of a person's hand to move the actuator portion and the second arm relatively closer together.

Implementations of the invention may include one or more of the following features. The slits have depths extending at non-perpendicular angles relative to a length of the top arm. The depths of the slits each extend at substantially a same acute angle relative to the length of the top arm.

Various aspects of the invention may provide one or more of the following capabilities. A capo configured for a stringed musical instrument can be more easily and comfortably operated than prior capos. A capo can be operated using less force to open the capo than with prior capos. A capo can accommodate any of a variety of neck configurations of stringed instruments, e.g., including necks with a C-shaped, D-shaped or V-shaped cross section.

These and other features and capabilities of the invention, along with the invention itself, will be more fully understood after a review of the following figures, detailed description, and claims.

DETAILED DESCRIPTION OF PREFERRED EMBODIMENTS

Embodiments of the invention provide a capo for use with a stringed musical instrument. The capo is constructed for secure and removable attachment to a finger or fret board of a neck portion of the stringed musical instrument, and is configured to facilitate a key or pitch change of the instrument's strings disposed longitudinally over the board. The capo preferably can be used six- or twelve-string guitars but can be configured for use with other stringed musical instruments, including, but not limited to, banjos, mandolins, ukuleles and bouzoukis. The capo includes a normally closed, spring-loaded frame including a top string engaging arm and a bottom clamping arm, pivotally attached to the top arm and configured to press against a bottom of the neck of the instrument. The capo further includes a handle extending downward from the top arm and a finger lever member extending downward from a bottom side of the bottom arm. A user can put the user's palm against the handle and pull on the lever with (e.g., two) fingers of the user's same hand to open the capo for placement on the instrument. Other embodiments are within the scope of the invention.

Figure 1:
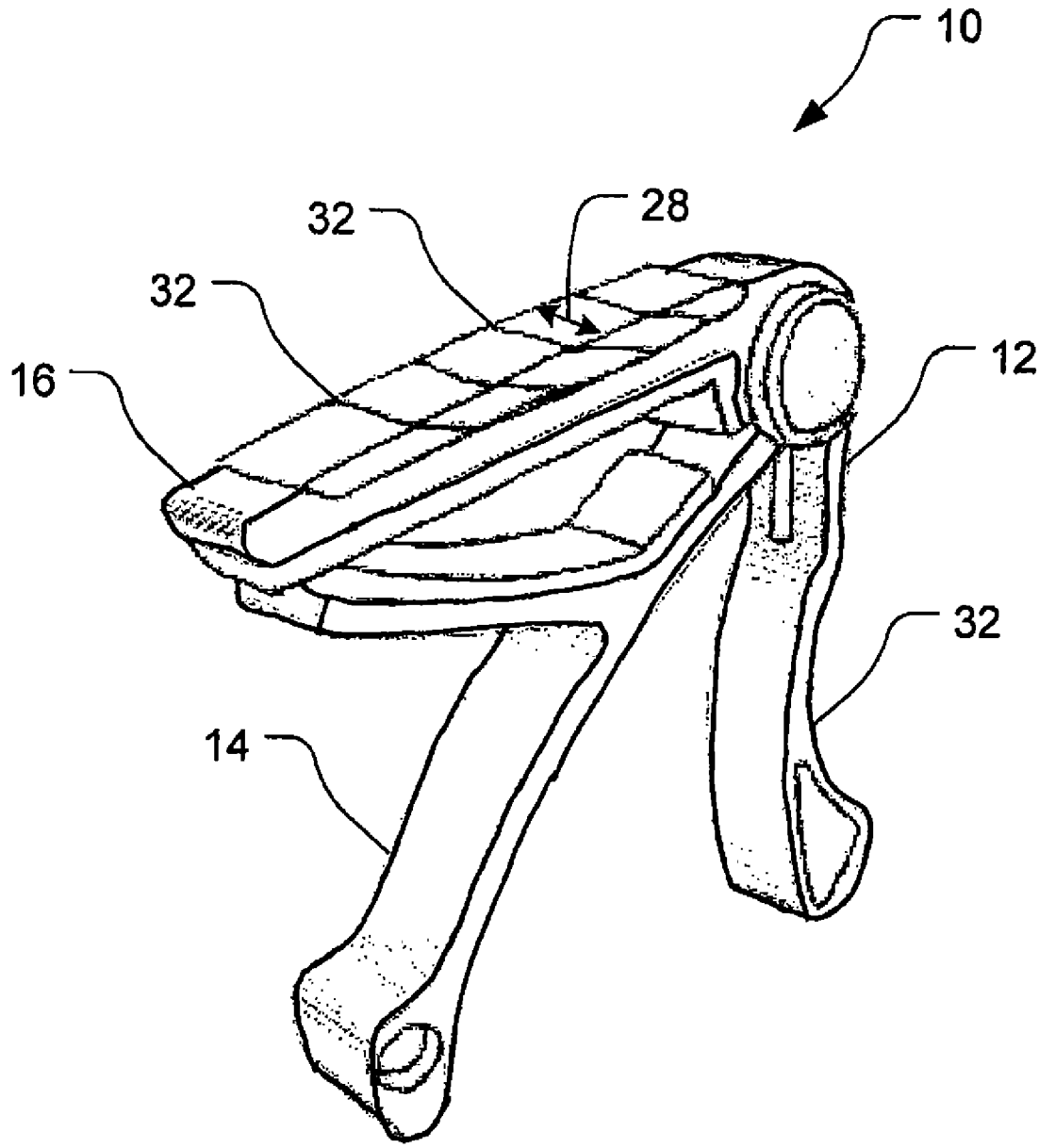
FIG. 1 is a perspective view of a capo.
Figure 2:
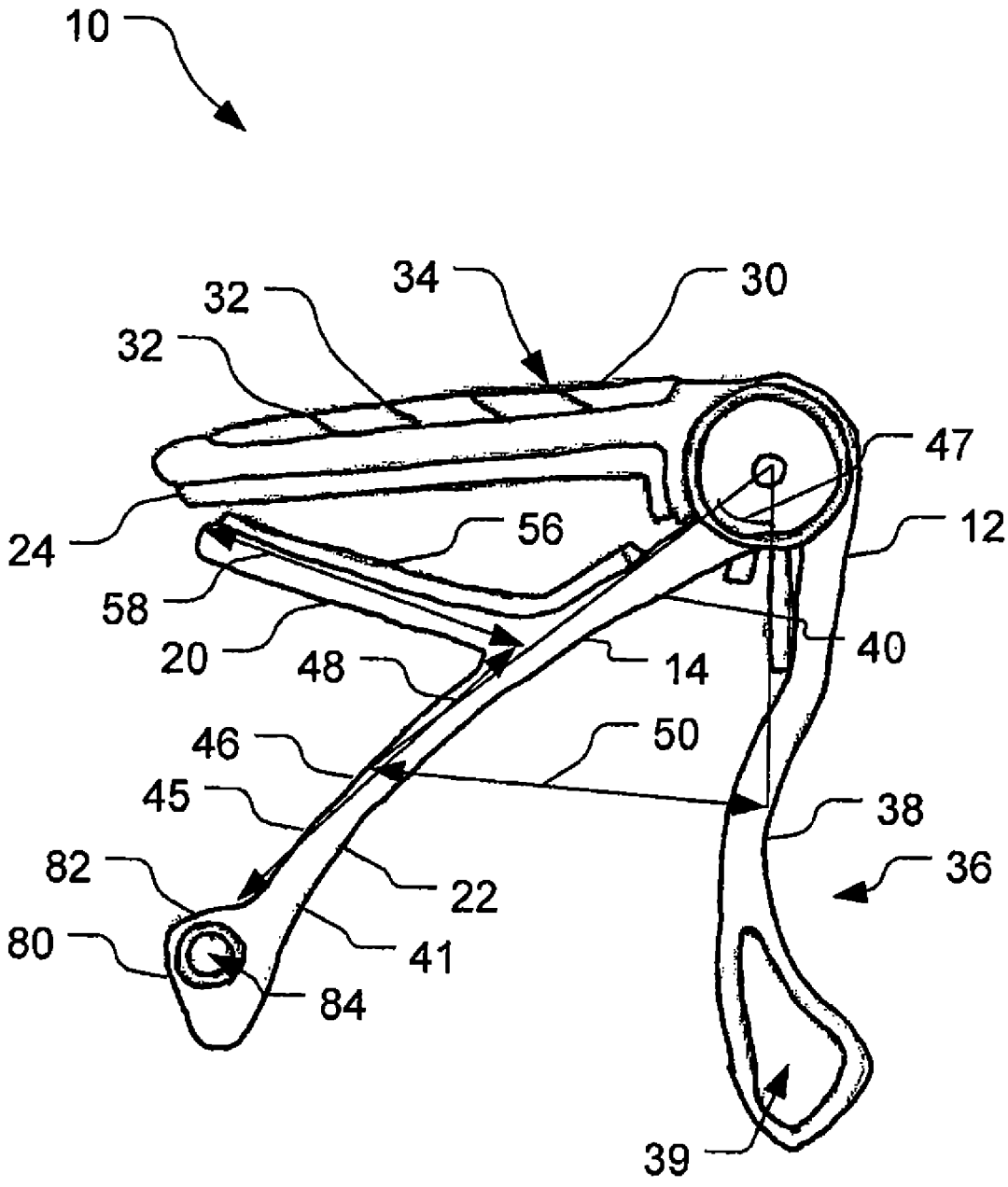
FIG. 2 is a side view of the capo shown in FIG. 1 in a closed position.

Referring to FIGS. 1-2, a capo 10 includes a frame 12 and a pivot arm 14. The frame 12 includes a top arm 16 and a leverage member 18. The pivot arm 14 includes a clamping portion 20 and an actuator arm 22. The capo 10 is configured to be opened by grasping the leverage member 18 and the actuator arm 22 and squeezing to draw the actuator arm 22 toward the leverage member 18. The open capo 10 can be placed along the neck of a stringed instrument such as a guitar and released, allowing a spring bias of the capo 10, that biases the capo 10 toward a closed position, to close the capo 10 onto the stringed instrument across strings of the instrument to change the pitch of the instrument.

The top arm 16 is configured to lie across and hold down strings of an instrument. The top arm 16 includes a string-engaging member 24. The member 24 is preferably a semi-rigid, resilient material for engaging strings of an instrument, receiving and conforming to the shape of the strings, and returning to its original shape when disengaged from the strings. For example, the member 24 may be made of rubber or other soft, dense materials, or other materials. The member 24 has a length 26 for extending over fret boards of typical instruments to engage all of the strings of the instrument. For example, the length 26 is preferably about two inches, although other lengths may be used. The top arm 24 has a width 28 that is less than the distance between frets where a user would typically want to use the capo 100. For example, the width 28 is preferably about ½ of an inch, and more preferably about 7/16 of an inch, although other widths may be used.

The top arm 16 further includes a pick holder 30. The pick holder 30 provides several, here four, slots or slits 32 for receiving guitar picks. The slits 32 are thin, with openings 34 less than the thickness of a typical guitar pick. For example, the slit openings 34 are preferably about 0.2 mm. The slits 32 are preferably angled relative to the length of the top arm 16, e.g., at about a 45° angle relative to the top arm length. The pick holder 30 is preferably a semi-rigid, resilient material for receiving guitar picks, and returning to its original shape when the pick(s) is(are) removed from the pick holder 30. The pick holder material, at least inside the slits 32, provides for frictional engagement of the picks to help retain the picks within the slits 32. For example, the pick holder 30 may be made of rubber or plastic, e.g., nylon. The pick holder 30 is disposed in a recess 34 of the top arm 16 such that the top of the pick holder 30 is substantially flush with the top of the top arm 16, although other configurations are possible.

The leverage member 18 extends downward from the top arm 16 and is configured to be placed against a user's hand or thumb. The leverage member 18 is integrally formed with the top arm 16 such that the frame 12 is a monolithic piece. The frame 12 is preferably made from a lightweight material such as aluminum, ceramic, or plastic. The leverage member 18 extends downward from the top arm 16 a sufficient distance, and has an ergonomic size and shape, such that the leverage member 18 can comfortably receive a portion of a user's hand or thumb. For example, the leverage member 18 extends downward from the top arm 16 with an overall length of about 3.25 inches. Further, the member 18 includes a contoured portion 36 that is concave on an outer surface 38. The contoured portion 36 begins about 1.5 inches from the top of the member 18. The contoured portion 36 may have a variety of shapes such as here being circular with radius of about one inch. The contoured portion 36 can comfortably receive portions of user such as a portion of the user's hand between the user's thumb and index finger, or the user's thumb disposed longitudinally along the length of the member 18 transverse to the length of the member 18, etc. An aperture 39 is provided in the leverage member 18 to help limit the weight of the capo 10.

The pivot arm 14 is pivotally connected to the frame 12. The pivot arm has a wye or wishbone shape including the clamping portion 20 and the actuator arm 22, which includes a base portion 40 and an actuator portion 41. The actuator arm 22 is pivotally connected to the frame 12 via a pivot pin 42, and biased away from the leverage member 18. A torsion spring 44 is wrapped around the pivot pin 42 and engages both the leverage member 18 and the base portion 40 to bias or urge the actuator arm 22 away from the leverage member 18 toward the normally-closed position shown in FIG. 2. The force provided by the torsion spring 44 is sufficient to hold the capo 10 against an instrument and to have the string-engaging member 24 engage strings of the instrument and hold them against a fret, while allowing a user to easily open the capo 10 by squeezing the leverage member 18 and the actuator arm 14 together. The base portion 40 and the actuator portion 41 both extend away from the top arm 16 at about the same angle when the capo 10 is in the closed position, although as shown the actuator arm 22 is curved such that the angle relative to the top arm 16 varies over the length of the arm 22, here increasing with distance.

The actuator arm 22 extends beyond the clamping portion 20 a distance sufficient to receive two of the user's fingers on a surface 45 of a finger-receiving portion 46. For example, the finger-receiving portion 46 has a length 48 of about 1.5 inches. The finger-receiving portion 46, and the clamping portion 20, are ergonomically sized, shaped, and disposed to allow a user to grasp and squeeze the capo 10. The finger-receiving portion 46 includes a knob 80 that provides a lip 82 configured to inhibit slippage of a user's finger while squeezing the capo 10. The knob 80 provides an aperture 84 to help limit the weight of the capo 10.

The capo 10 is ergonomically configured to be grasped by a person. In the closed position shown in FIG. 2, a center point of the contoured portion 36 is disposed about 1.75 inches from a center point of the finger-receiving portion 46 as indicated by a distance 50. A lever arm 52 of the capo 10 from a center of the pivot pin 42 to a midpoint 54 of the finger-receiving portion 46 is about 2.25 inches, although other distances are possible. Also in the closed position, an angle 47 between the center point of the contoured portion 36 and the midpoint of the finger-receiving portion 46, whose vertex is at the pivot axis of the pivot pin 42, is between about 45° and about 60° and preferably between about 50° and about 55°. The frame 12 and the pivot arm 14 are configured such that when the capo 10 is in the closed position shown in FIG. 2, and the user's hand grasps the capo 10 with the leveraged member 18 receiving the portion of the user's hand between the thumb and forefinger, and the finger-receiving portion 46 receiving the user's index and middle fingers, the user's natural direction of movement of the user's index and middle fingers when curling toward the user's palm will be substantially perpendicular to the lever arm 52 between the center of the pivot pin 42 and the midpoint 54.

Figure 3:
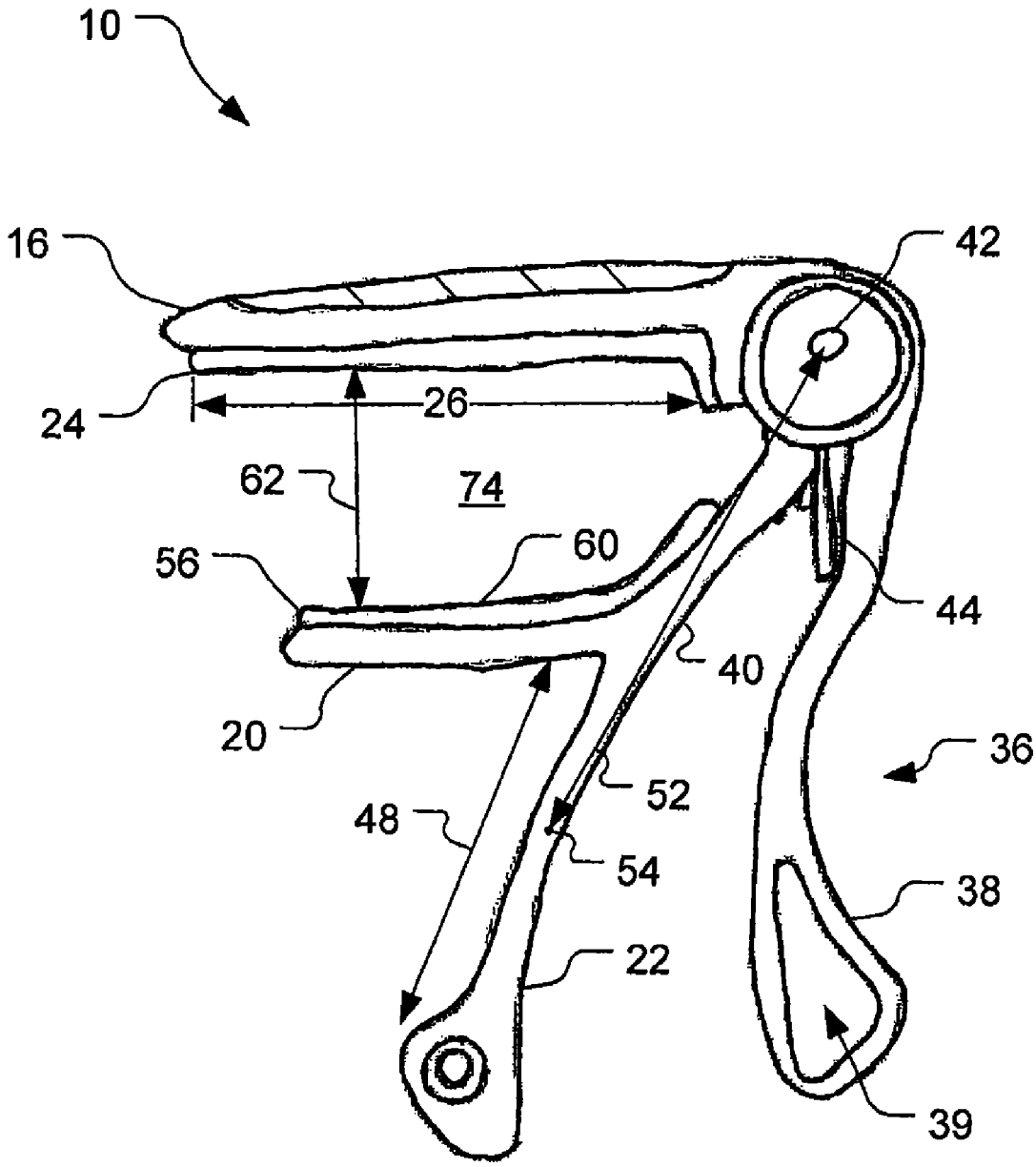
FIG. 3 is a side view of the capo shown in FIG. 1 in an open position.
Figure 4:
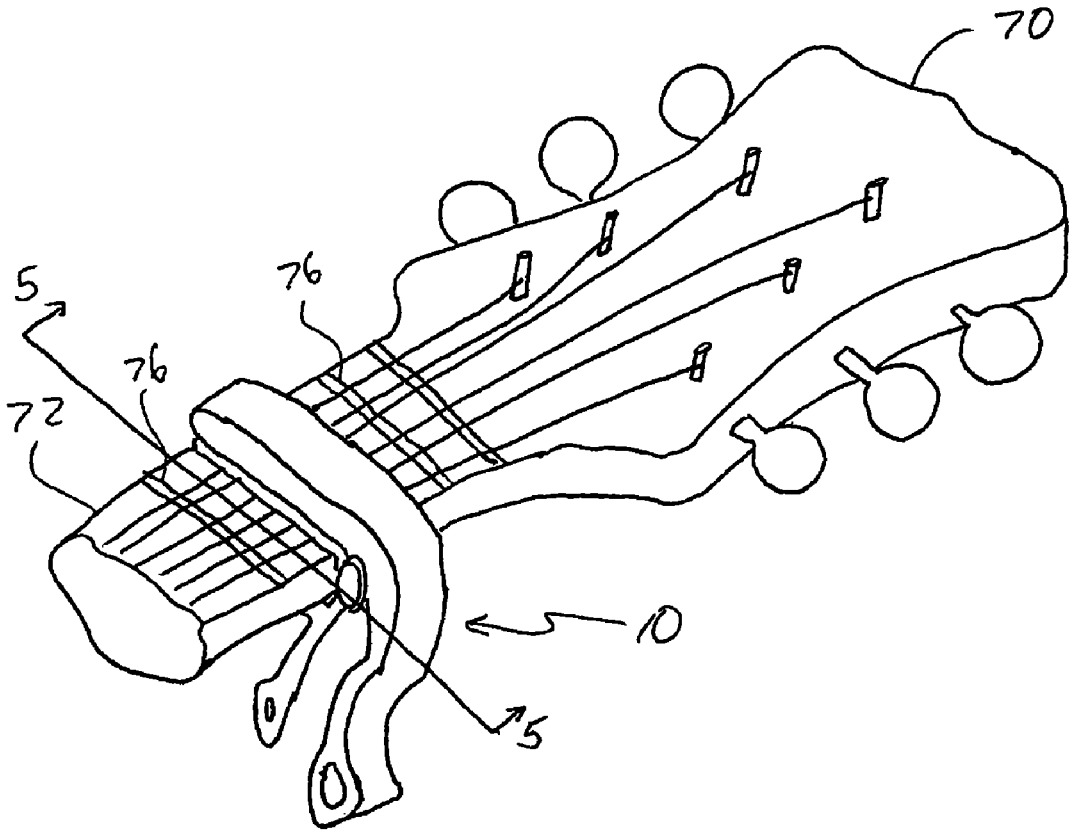
FIG. 4 is a perspective view of the capo shown in FIG. 1 is use with a guitar.
Figure 5:
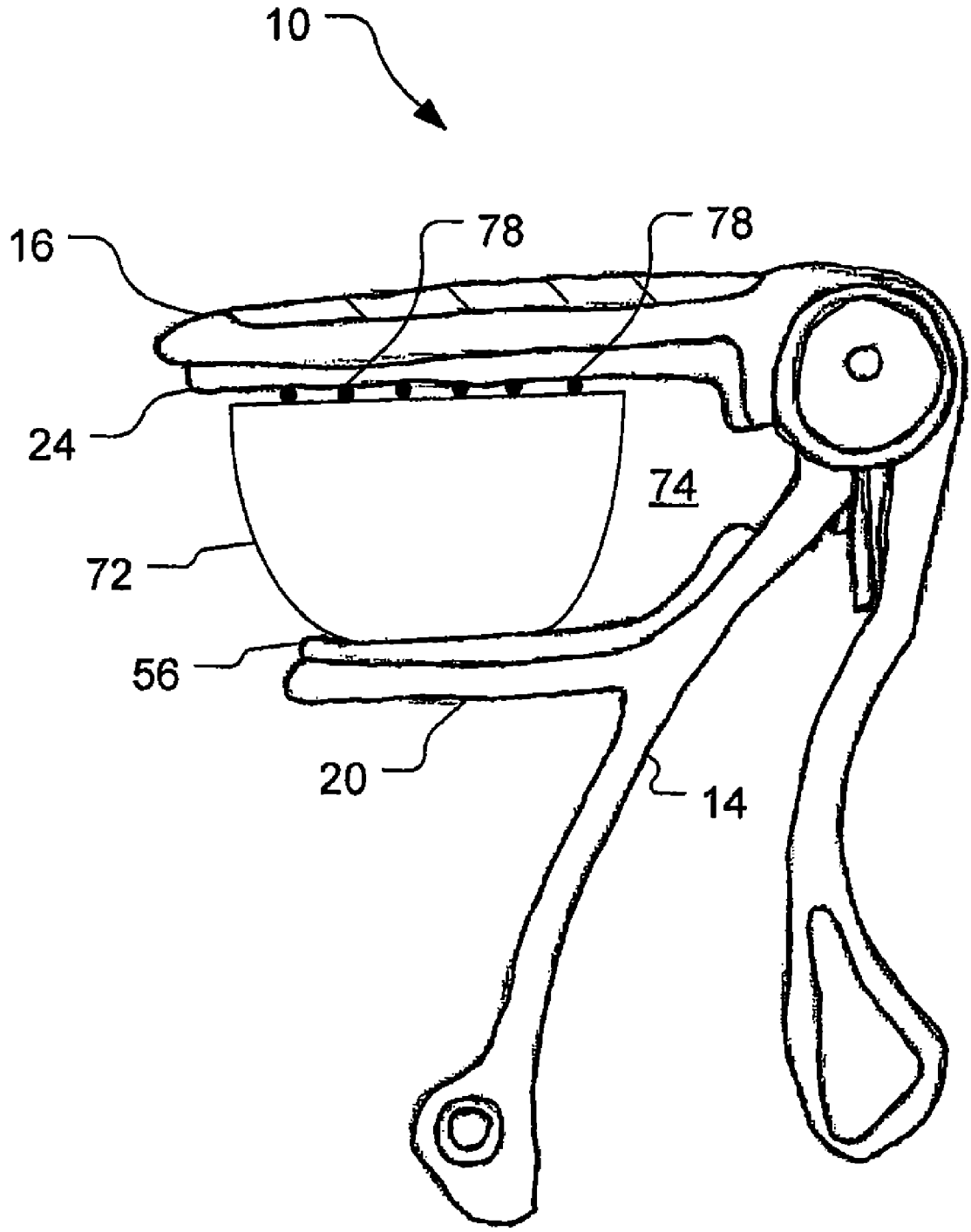
FIG. 5 is a cross-sectional view of the guitar shown in FIG. 4 taken along line 5-5 in FIG. 4, with the capo in use with the guitar.

The clamping portion 20 of the pivot arm 14 extends upwardly away from the actuator arm 22. The clamping portion 20 extends away from the actuator arm 22 at about a 45 degree angle, although other angles are possible. A pad 56 is attached to the clamping portion 20 and a portion of the base portion 40. The pad 56 is configured to frictionally engage a guitar neck or other instruments with which the capo 10 is used to inhibit movement of the capo 10 when engaged with the instrument. Further, the pad 56 comprises a material configured to engage with the instrument substantially without marring the instrument. For example, the pad 56 may be made of rubber or other soft, dense materials, or other materials. The clamping portion 20 has a length 58 of about 1.6 inches and is configured to contact that top arm 16 when in a closed position shown in FIG. 2. In particular, the pad 56 engages with the string-engaging member 24 when the capo 10 is in the closed position. The clamping portion 20 extends away from the actuator arm 22 and is configured such that when the capo 10 is in the open position shown in FIG. 3 with the clamping portion 20 approximately parallel to he top arm 16, a top service 60 of the pad 56 is displaced a distance 62 sufficient to receive stringed instruments for which the capo 10 is to be used. For example, the distance 62 may be about 1 inch from a bottom surface 64 of the string-engaging member 24. The top arm 16 and the actuator arm 14 are configured to accommodate instrument necks having a variety of cross sections including, but not limited to, C-shaped, D-shaped, or V-shaped cross sections. The pivot arm 14 is preferably made of a material similar to the frame 12, such as aluminum.

The capo 10 is designed for easy manufacture. The frame and pivot arm can be made using known techniques such as casting. The string-engaging member 24, the pick holder 30, and the pad 56 can be attached, e.g., by gluing, to the frame 12 and the pivot arm 14, respectively. The frame 12, the pivot arm 14, and the spring 42 can be placed in their relative positions shown in FIG. 2, and the pivot pin 42 inserted through the coiled spring 42, and end caps placed over the pivot pin to inhibit undesired disassembly of the capo 10.

In operation, referring to FIGS. 1-5, the capo 10 can be quickly and easily positioned at a desired location on a stringed instrument, and picks quickly and easily stored and accessed. A user can open the capo 10 by grasping the capo 10, e.g., by placing the contoured potion 36 of the leverage member 18 against the user's palm or thumb, by placing one or more of the user's fingers, e.g., the index and middle fingers, against the surface 45 of the finger-receiving portion 46 and squeezing to overcome the torsion provided by the spring 44. The actuator arm 14 will move toward the leverage member 18, pivoting around the pivot pin 42. The user can squeeze until the capo 10 is open sufficiently to receive a neck 72 of an instrument 70 such as a guitar. The user can move the capo 10 onto the neck 72 of the instrument 70 such that the neck 72 is received by an opening 74 between the top arm 16 and the actuator arm 14 when the capo 10 is in the open position. The user places the capo 10 between desired frets 76 of the instrument 70 and releases or lessens the squeezing pressure on the capo 10 such that the actuator arm 14 pivots toward the top arm 16 and the pad 56 engages a bottom of the neck 72 and the string-engaging member 24 engages strings 78 of the instrument 70. The user can remove picks from the slits 32 for use in playing the instrument 70, and insert picks into the slits 32 for later use in playing the instrument 70. To remove the capo 10 from the instrument 70, the user again squeezes the capo 10 as before, and pulls the capo 10 away from the instrument 70 before releasing the pressure on the capo 10.

Other embodiments are within the scope and spirit of the appended claims. For instance, different shapes and/or dimensions than those mentioned may be used, e.g., to accommodate different hand sizes of users, such as an adult-sized hand or a child-sized hand. Further, different dimensions may be used to accommodate different instrument types, sizes, or shapes.

What is claimed is:

1. A capo for use with a stringed musical instrument, the capo comprising:

a frame comprising:

a first arm having distal and proximal ends and being configured to extend across a neck of the instrument and engage strings of the instrument; and a second arm connected to the proximal end of the first arm and extending from the first arm at a first angle less than 180°, the second arm configured and disposed to receive a portion of a person's hand; and a pivot arm that is substantially Y-shaped, including a base portion, a clamp portion, and an actuator portion, a proximal end of the base portion being pivotally connected to the frame to move between open and closed positions, the base-portion extending away from the frame inside the first angle, a proximal end of the actuator portion connected to a distal end of the base portion, the actuator portion extending away from the base portion, the first arm, and the second arm when the pivot arm is in the closed position, a proximal end of the clamp portion connected to the distal end of the base portion, the clamp portion extending away from the base portion toward the first arm when the pivot arm is in the closed position, the base portion being biased away from the second arm such that the clamp portion is biased toward the first arm, wherein a distance from the proximal end of the clamp portion to the proximal end of the base portion is about the same or less than a distance from the proximal end of the clamp portion to a distal end of the clamp portion, wherein the actuator portion has a finger receiving portion that includes a knob that provides a lip to inhibit slippage of a user's fingers while squeezing the capo, wherein the second arm has a concave outer surface for receiving a portion of a person's hand.

2. The capo of claim 1 wherein the base portion extends away from the frame at a second angle relative to the first arm when the pivot arm is in the closed position and the actuator portion extends away from the first arm at substantially the second angle relative to the first arm when the pivot arm is in the closed position.

3. The capo of claim 1 the further comprising a pick holder connected to the top arm and configured to removably hold at least one guitar pick.

4. The capo of claim 1 wherein the base portion has a length of about three-fourths of a length of the actuator portion.

5. The capo of claim 1 wherein the actuator portion includes a finger-receiving portion configured to receive fingers of a user of the capo, wherein a first distance from a pivot point of the pivot arm to a midpoint of the finger-receiving portion of the actuator portion is about 2.25 inches, and a second distance from the midpoint of the finger-receiving portion to a midpoint of a contoured portion of the second aim is about 1.75 inches.

6. The capo of claim 1 wherein the actuator portion is substantially linearly aligned with the base portion.

7. The capo of claim 1 wherein a distance between the proximal end of the actuator portion and the proximal end of the first arm is about the same or less than a distance between the proximal end of the actuator portion and the distal end of the first arm.

8. The capo of claim 1 wherein the base portion extends away from the first arm over an entire length of the base portion and the clamp portion extends toward the first arm over an entire length of the clamp portion.

9. A capo for use with a stringed musical instrument, the capo comprising:

a frame comprising:

a first arm having distal and proximal ends and being configured to extend across a neck of the instrument and engage strings of the instrument; and a second arm connected to the proximal end of the first arm and extending from the first arm at a first angle less than 180°, the second arm configured and disposed to receive a portion of a person's hand;

a pivot arm that is substantially Y-shaped, including a base portion, a clamp portion, and an actuator portion, a proximal end of the base portion being pivotally connected to the frame to move between open and closed positions, the base portion extending away from the frame inside the first angle, a proximal end of the actuator portion connected to a distal end of the base portion, the actuator portion extending away from the base portion, the first arm, and the second arm when the pivot arm is in the closed position, a proximal end of the clamp portion connected to the distal end of the base portion the clamp portion extending away from the base portion toward the first arm when the pivot arm is in the closed position, the base portion being biased away from the second arm such that the clamp portion is biased toward the first arm; and a pick holder connected to the top arm and configured to removably hold at least one guitar pick, wherein the pick holder provides, a plurality of slots having widths smaller than thicknesses of guitar picks and having depths extending at acute angles relative to a length of the top arm.

10. A capo for use with a guitar, the capo comprising:

a frame comprising:

a first arm having distal and proximal ends and being configured to extend across a neck of the instrument and engage strings of the instrument, the first arm providing a plurality of slits having widths smaller than thicknesses of guitar picks; and a second arm connected to the proximal end of the first arm and extending from the first arm at a first angle less than 180°, the second arm configured and disposed to receive a portion of a person's hand; and a pivot arm pivotally connected to the frame and including a clamp portion and an actuator portion, the clamp portion being configured to engage a bottom of a neck of the stringed instrument, the actuator portion being configured to be engaged by a portion of a person's hand to move the actuator portion and the second arm relatively closer together.

11. The capo of claim 10 wherein the slits have depths extending at non-perpendicular angles relative to a length of the top arm.

12. The capo of claim 10 wherein the depths of the slits each extend at substantially a same acute angle relative to the length of the top arm.

* * * * *